US007878624B2

(12) United States Patent
Kawashima

(10) Patent No.: US 7,878,624 B2
(45) Date of Patent: Feb. 1, 2011

(54) IMAGE FORMING APPARATUS

(75) Inventor: Yasuhiro Kawashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 346 days.

(21) Appl. No.: 11/359,862

(22) Filed: Feb. 21, 2006

(65) Prior Publication Data

US 2006/0187504 A1 Aug. 24, 2006

(30) Foreign Application Priority Data

Feb. 24, 2005 (JP) ..... 2005-048336

(51) Int. Cl.
*B41J 23/00* (2006.01)
*B41J 29/13* (2006.01)

(52) U.S. Cl. ..... 347/37; 347/108

(58) Field of Classification Search ..... 347/2, 347/108, 37, 85, 84
See application file for complete search history.

(56) References Cited

U.S. PATENT DOCUMENTS

| | | | | |
|---|---|---|---|---|
| 5,245,365 | A | 9/1993 | Woodard et al. | |
| 5,367,328 | A | 11/1994 | Erickson | |
| 5,369,429 | A | 11/1994 | Erickson | |
| 5,408,257 | A * | 4/1995 | Hiramatsu et al. | 347/92 |
| 6,024,441 | A * | 2/2000 | Nishimoto | 347/85 |
| 6,082,854 | A | 7/2000 | Axtell et al. | |
| 6,234,626 | B1 | 5/2001 | Axtell et al. | |
| 6,257,717 | B1 | 7/2001 | Axtell et al. | |
| 6,264,322 | B1 | 7/2001 | Axtell et al. | |
| 6,588,869 | B1 * | 7/2003 | Batra et al. | 347/3 |
| 6,923,535 | B2 * | 8/2005 | Koga | 347/108 |
| 7,055,944 | B2 * | 6/2006 | Konishi | 347/100 |
| 7,370,949 | B2 * | 5/2008 | Shiho et al. | 347/85 |

FOREIGN PATENT DOCUMENTS

| | | |
|---|---|---|
| EP | 419876 A1 | 4/1991 |
| JP | 5-124214 | 5/1993 |
| JP | 6-344626 | 12/1994 |
| JP | 2002-1983 | 1/2002 |
| JP | 2002-273861 | 9/2002 |
| JP | 2003-211700 | 7/2003 |
| WO | WO99/47355 | 9/1999 |

* cited by examiner

*Primary Examiner*—Julian D Huffman
*Assistant Examiner*—Jason S Uhlenhake
(74) *Attorney, Agent, or Firm*—Copper & Dunham LLP

(57) ABSTRACT

An image forming apparatus in which air or dust does not enter a recording liquid tube when an ink cartridge is changed is disclosed. An engine unit, in which an image forming section and a sub scanning direction paper carrying section are integrated as one unit, is removably attached to an apparatus main body of the image forming apparatus. Further, an ink cartridge storing section, in which an ink cartridge is removably stored, is integrated into the engine unit, and is changed together with the engine unit. In addition, a carriage, the recording liquid tube, and the ink cartridge storing section are removed as one unit from the engine unit.

8 Claims, 13 Drawing Sheets

IMAGE FORMING APPARATUS

BACKGROUND

1. Technical Field

This disclosure generally relates to an image forming apparatus that forms an image by a recording head which ejects ink droplets of recording liquid.

2. Description of the Related Art

As an image forming apparatus such as a printer, a facsimile, a copying apparatus, and a multifunctional apparatus that has the above functions, an apparatus which uses an electro-photographic system for forming an image is widely known. In addition, there is an image forming apparatus which uses an inkjet system for forming an image. In the inkjet system, a recording head composed of ink droplet ejecting heads which eject ink droplets of recording liquid is used, and an image is formed on a recording medium (paper) by ejecting the ink droplets of the recording liquid onto the recording medium from the recording head while carrying the recording medium. In this, the recording medium is not limited to a paper, and any other recording medium such as an image transferring medium can be used as the recording medium; and as the image forming, image recording, image printing, letter printing, and so on are included.

In Patent Document 1, a conventional inkjet recording apparatus is disclosed. The inkjet recording apparatus includes a recording liquid supplying mechanism of a sub ink tank type in which a recording head unit and sub ink tanks that supply recording liquid to recording heads are provided in a carriage.

In Patent Document 2, another conventional inkjet recording apparatus is disclosed. In the inkjet recording apparatus providing a recording liquid supplying mechanism using a tube that supplies recording liquid to a recording head, the recording head is easily changed. In order to easily handle the tube and to change only members to be required when the recording head is changed, the recording head is removably attached to a carriage and a connector holding the tube is removably attached to the recording head.

In Patent Document 3, another conventional inkjet recording apparatus is disclosed. In the inkjet recording apparatus, each of recording heads is separately changed. When plural ink supplying tubes are connected to the plural recording heads or sub ink tanks disposed in a carriage, the tubes are held via a holding member that provides a hole without having a notch and holes having a notch.

In Patent Document 4, another conventional inkjet recording apparatus is disclosed. In the inkjet recording apparatus, a recording head is easily changed. The inkjet recording apparatus provides a carriage formed by a different member from a sub ink tank, the sub ink tank, and a recording head which is removably attached to the sub ink tank, and the sub ink tank has a suction opening which opens only at a predetermined time when being suctioned from the outside, with this, an ink supplying mechanism is simplified.

In Patent Document 5, a conventional inkjet printer of a module type is disclosed. In the inkjet printer, one end of a tube is connected to a recording head and the other end of the tube is connected to an ink reservoir, and plural ink reservoirs are installed in a housing. Then, the recording head, the tube, and the ink reservoir are removed as one unit.

In Patent Document 6, a conventional inkjet printer is disclosed. The inkjet printer does not have a recording liquid tube for supplying recording liquid to a recording head. However, in order to miniaturize the printer and to have high maintainability, a carriage moving space is formed between right and left frame side plate members and a recording paper carrying section is disposed in the front of the printer and an ink supplying section is disposed in the back of the printer. A head maintenance unit is disposed in a space at the rear side part and the side part of the recording paper carrying section. The head maintenance unit and a recording paper carrying unit are removably attached to the right and left side frame plate members.

[Patent Document 1] Japanese Laid-Open Patent Application No. 2002-001983

[Patent Document 2] Japanese Laid-Open Patent Application No. 2003-211700

[Patent Document 3] Japanese Laid-Open Patent Application No. 6-344626

[Patent Document 4] Japanese Laid-Open Patent Application No. 5-124214

[Patent Document 5] Japanese Translation of PCT International Application No. 2002-506758 (WO 99/47355)

[Patent Document 6] Japanese Laid-Open Patent Application No. 2002-273861

However, as described above, in Patent Documents 1 and 4, in the structure in which the recording liquid is supplied from a recording liquid storing unit to the recording head or the sub ink tank by using the recording liquid tube, the recording head is easily exchanged by making the connection and the disconnection between the recording head and the recording liquid tube easy. However, in some cases, the inkjet recording apparatus does not work normally after exchanging the recording head due to air or dust entering in the recording liquid tube when removing the recording liquid tube.

In Patent Document 5, the recording head, the tube, and the ink reservoir are removed as one unit; therefore, there is no need to remove only the tube. However, when the ink in the ink reservoir is used up, all of the recording head, the tube, and the ink reservoir must be removed and this results in a high cost. In a case where only the ink reservoir is removed, the ink reservoir and the tube are disconnected and air or dust may enter the tube. Consequently, the inkjet printer may not work normally after exchanging the recording head.

SUMMARY

In a preferred embodiment of this disclosure, there is provided an image forming apparatus which has high maintainability and high productivity while preventing unnecessary air and dust from entering a recording liquid tube.

In an aspect of this disclosure, there is provided an image forming apparatus. The image forming apparatus includes an engine unit which forms an image on a recording medium by moving a carriage in the main scanning direction and by carrying the recording medium in the sub scanning direction. The carriage includes a recording head for ejecting droplets of recording liquid and a sub tank for supplying the recording liquid to the recording head. The engine unit can be removed and attached to a main body of the image forming apparatus. The image forming apparatus further includes an ink cartridge storing unit that stores a recording liquid cartridge for supplying recording liquid to the sub tank via a recording liquid tube such that the recording liquid cartridge can be removed and attached to the ink cartridge storing unit, and the ink cartridge storing unit is integrated to the engine unit. The carriage, the recording liquid tube, and the ink cartridge storing unit can be removed from the engine unit as one unit.

In this, it is preferable that the recording liquid tube is disposed at the inside of a frame outside the main scanning region of the carriage of the engine unit.

In addition, it is preferable that the engine unit has a carrying unit that can be removed and attached to the engine unit, and the carrying unit has carrying members that include a carrying belt for carrying the recording medium such that the carrying members are integrated as one unit. In this case, it is preferable that the engine unit holds the carrying unit such that the carrying unit can be moved to a position where a guide member, which guides the carriage to move in the main scanning direction, does not exist when the carrying unit is exchanged to remove from or attach to the engine unit.

In an embodiment of this disclosure, the image forming apparatus includes an engine unit which forms an image on a recording medium by moving a carriage in the main scanning direction and by carrying the recording medium in the sub scanning direction. The carriage includes a recording head for ejecting droplets of recording liquid and a sub tank for supplying the recording liquid to the recording head. The engine unit can be removed and attached to a main body of the image forming apparatus. The image forming apparatus further includes an ink cartridge storing unit that stores a recording liquid cartridge for supplying recording liquid to the sub tank via a recording liquid tube such that the recording liquid cartridge can be removed and attached to the ink cartridge storing unit, and the ink cartridge storing unit is integrated to the engine unit. The carriage, the recording liquid tube, and the ink cartridge storing unit can be removed from the engine unit as one unit. Therefore, when the recording liquid cartridge is changed, air or dust is prevented from entering the recording liquid tube. Further, since the entire ink supplying mechanism (recording liquid supplying mechanism) can be changed, maintainability and assemble-ability can be improved.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENT

Best Mode of Carrying Out the Invention

A best mode of carrying out the present invention is described with reference to the accompanying drawings.

An image forming apparatus according to an embodiment of the present invention is explained.

Figure 1:
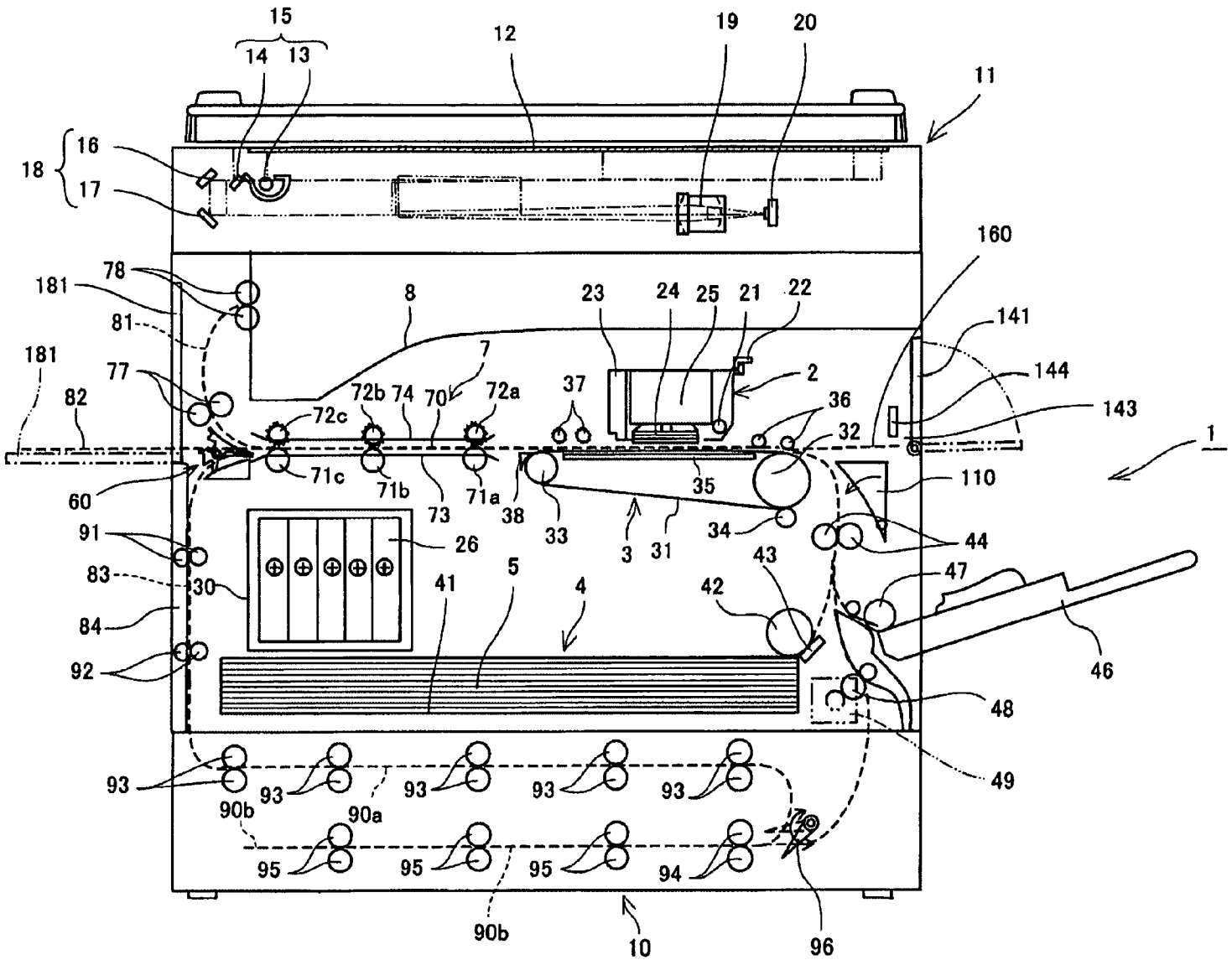
FIG. 1 is a diagram showing an outline of a structure of an image forming apparatus according to an embodiment of the present invention.
Figure 2:
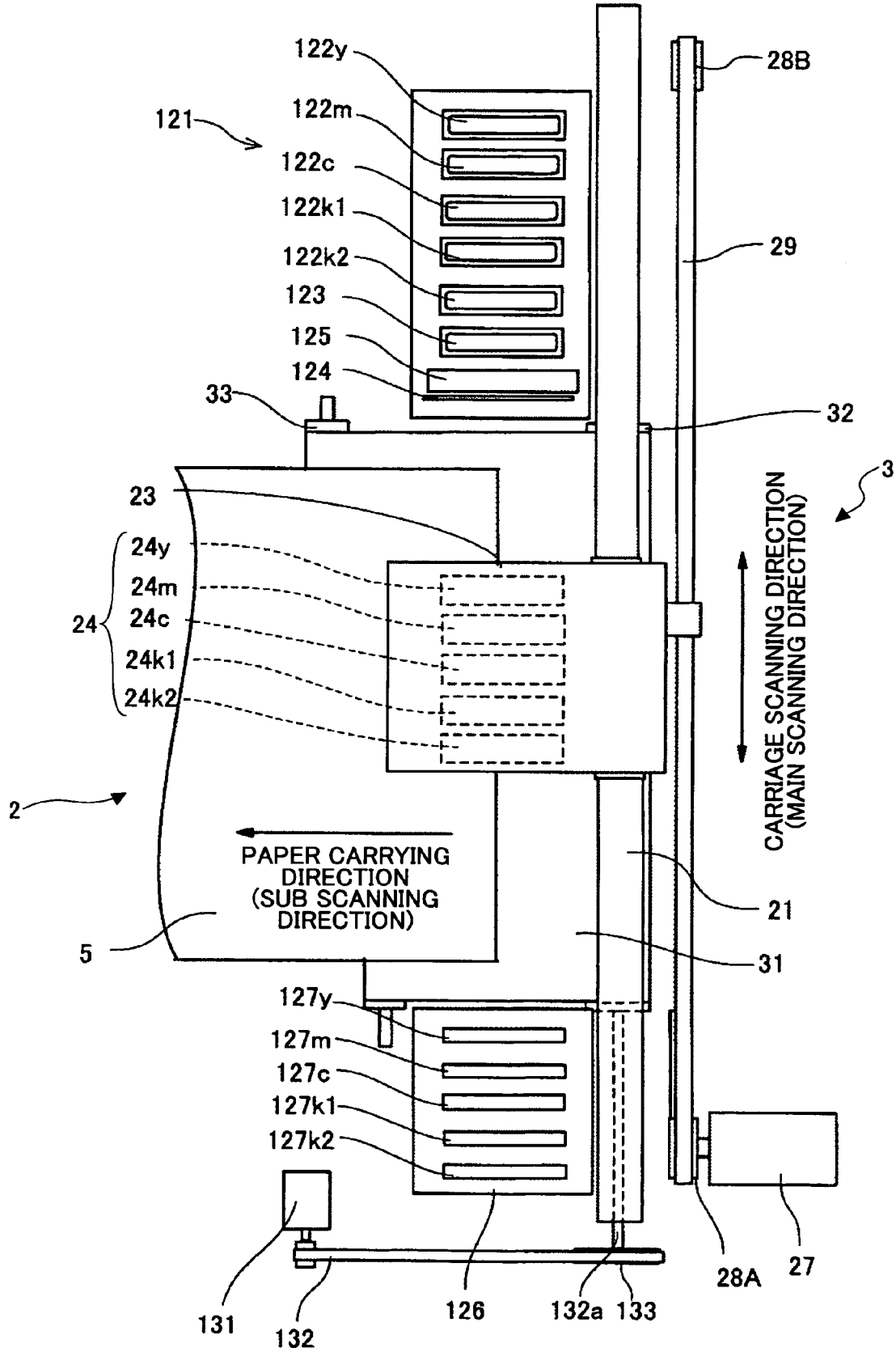
FIG. 2 is a plan view of an image forming section and a sub scanning direction paper carrying section in the image forming apparatus shown in FIG. 1.
Figure 3:
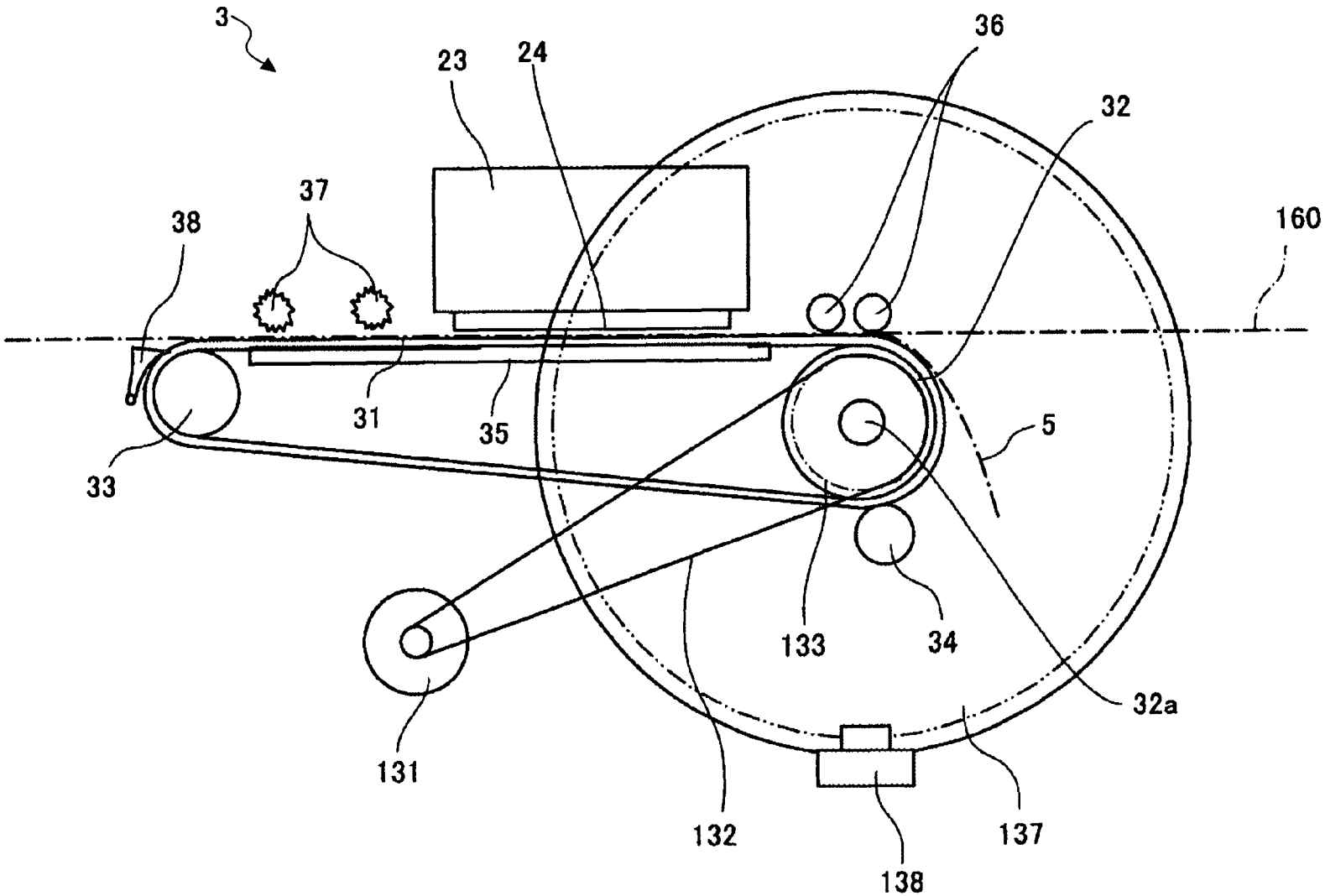
FIG. 3 is a side view of the sub scanning direction paper carrying section shown in FIG. 1.

FIG. 1 is a diagram showing an outline of a structure of the image forming apparatus according to the embodiment of the present invention. FIG. 2 is a plan view of an image forming section and a sub scanning direction paper carrying section in the image forming apparatus shown in FIG. 1. FIG. 3 is a side view of the sub scanning direction paper carrying section shown in FIG. 1.

Referring to FIGS. 1 through 3, the image forming apparatus according to the embodiment of the present invention is explained.

The image forming apparatus provides an image forming section 2 that forms an image on a paper (recording medium) and a sub scanning direction paper carrying section 3 that carries a paper in an apparatus main body 1. In the image forming apparatus, each paper 5 is fed from a paper feeding section 4 including a paper feeding cassette disposed on the bottom face of the apparatus main body 1. The paper 5 is carried by the sub scanning direction paper carrying section 3 at the position facing the image forming section 2, and an image is formed (recorded) on the paper 5 by ejecting ink droplets on the paper 5 by the image forming section 2. In a case of one side printing (forming), the paper 5 is output on a paper outputting tray 8 disposed at the upper face of the apparatus main body 1 via a paper outputting section 7. In a case of both sides printing, the paper 5 is sent to an image forming (printing) on both sides unit 10 disposed at the bottom face of the apparatus main body 1 from the middle of the paper outputting section 7. A switchback is applied to the paper 5, the paper 5 is fed to the sub scanning direction paper carrying section 3 again, and the paper 5 on whose both sides images are formed is output on the paper outputting tray 8.

In addition, the image forming apparatus provides an image reading section 11 (scanner) for reading an image above the paper outputting tray 8 in the apparatus main body 1, as an image data (printing data) inputting section for forming an image in the image forming section 2. In the image reading section 11, an image of a manuscript placed on a contact glass 12 is read by moving a first scanning optical unit 15 including a light source 13 and a mirror 14, and a second scanning optical unit 18 including mirrors 16 and 17. The scanned (read) manuscript image is read as image signals by an image reading element 20 disposed behind a lens 19. The read image signals are digitized, and the digitized image is processed, and the processed image data are printed as an image.

Further, as input data of image data (printing data) from which the image forming section 2 forms an image, the image forming apparatus can receive image data (printing data) from an external information processing apparatus (host computer) such as a personal computer, an external image reading apparatus such as an image scanner, and a picture taking apparatus such as a digital camera via a cable or a network, and can print an image by processing the received image data.

As shown in FIG. 2, the image forming section 2 of the image forming apparatus provides a main scanning direction driving mechanism. The main scanning direction driving mechanism movably holds a carriage 23 in the main scanning direction by a guide rod 21 (guide member) and a guide stay (not shown) and scans a manuscript by moving the carriage 23 in the main scanning direction via a timing belt 29 that is hung around a driving pulley 28A and a driven pulley 28B by the drive of a main scanning direction motor 27.

A recording head 24 composed of ink droplet ejecting heads each of which heads ejects a different color ink droplet is installed on the carriage 23. An image is formed by moving the carriage 23 in the main scanning direction and carrying the paper 5 in the paper carrying direction (sub scanning direction) by the sub scanning direction paper carrying section 3 while causing the recording head 24 to eject ink droplets. That is, the image forming apparatus is a shuttle type.

The recording head 24 is composed of two ink droplet ejecting heads 24*k*1 and 24*k*2 that eject black ink (Bk), an ink droplet ejecting head 24*c* that ejects cyan ink (C), an ink droplet ejecting head 24*m* that ejects magenta ink (M), and an ink droplet ejecting head 24*y* that ejects yellow ink (Y). In this, when color is not referred to, the recording head 24 is used to represent the five ink droplet ejecting heads. Each color ink is supplied from a sub tank 25 (refer to FIG. 1) installed in the carriage 23 to each of the ink droplet ejecting heads 24*k*1 to 24*y*.

As shown in FIG. 1, ink cartridges 26 that are recording liquid cartridges in which corresponding black, cyan, magenta, and yellow ink is contained are removably attached to an ink cartridge storing section (unit) 30 from the front of the apparatus main body 1. Color ink is supplied to the corresponding sub tank 25 for each color from the ink cartridges 26. In the image forming apparatus, the black ink is supplied to two sub tanks from two ink cartridges 26.

In the recording head 24, as a pressure generator (actuator) that applies pressure to ink in an ink flowing route (pressure generating chamber), there are a piezoelectric type pressure generator, a thermal type pressure generator, an electrostatic type pressure generator, and so on. In the piezoelectric type pressure generator, ink droplets are ejected by changing the volume of the ink flowing route with deformation of vibration plates by which the walls of the ink flowing route are formed by using a piezoelectric element. In the thermal type pressure generator, the ink droplets are ejected by pressure of bubbles generated by heated ink in the ink flowing route by using a heating resistor. In the electrostatic type pressure generator, vibration plates by which the walls of the ink flowing route are formed are positioned to face electrodes, and the ink droplets are ejected by changing the volume of the ink flowing route with deformation of the vibration plates by an electrostatic force generated between the vibration plates and the electrodes. Any one of them can be used in the embodiment of the present invention.

In addition, as shown in FIG. 2, in a non-printing region located at one side in the scanning direction of the carriage 23 in the apparatus main body 1, a nozzle maintaining and recovering unit 121 which maintains a normal state of nozzles of the recording head 24 and recovers from an abnormal state thereof is disposed. The nozzle maintaining and recovering unit 121 provides five humidity keeping caps 122*k*1, 122*k*2, 122*c*, 122*m*, and 122*y* for capping nozzle faces of the corresponding five recording heads 24*k*1, 24*k*2, 24*c*, 24*m*, and 24*y*, a suction cap 123, a wiper blade 124 for wiping the nozzle faces of the recording heads, and a remaining ink droplet receiving member 125 for receiving ink droplets which do not contribute to forming an image. In this, when color is not referred to, a humidity keeping cap 122 is used to represent the five humidity keeping caps.

Further, as shown in FIG. 2, in a non-printing region located at the other side in the scanning direction of the carriage 23 in the apparatus main body 1, a remaining ink droplet receiving member 126 for receiving ink droplets which do not contribute to forming an image from the five recording heads 24 is provided. The remaining ink droplet receiving member 126 provides five openings 127*k*1, 127*k*2, 127*c*, 127*m*, and 127*y* for the five recording heads 24. In this, when color is not referred to, an opening 127 is used to represent the five openings.

As shown in FIGS. 1 through 3, the sub scanning direction paper carrying section 3 provides a carrying roller 32, a driven roller 33, a carrying belt 31, a charging roller 34, a guiding member 35, two pushing rollers 36, two spurring roller 37, and a paper separating claw 38. The carrying roller 32 carries the paper 5 fed from the paper feeding section 4 by changing the carrying direction by approximate 90 degrees to face the image forming section 2. The carrying belt 31 is an endless belt being hung around the carrying roller 32 that is a driving roller and the driven roller 33 that is a tension roller. The charging roller 34 applies a high alternating voltage from a high voltage power source to the carrying belt 31 so that the face of the carrying belt 31 is charged. The guiding member 35 guides the carrying belt 31 at the region facing the image forming section 2. The two pushing rollers 36 push the paper 5 onto the carrying belt 31 at the position facing the carrying roller 32. The two spurring roller 37 push the upper face of the paper 5 on which an image is formed by the image forming section 2. The paper separating claw 38 separates the paper 5 on which the image is formed from the carrying belt 31.

The carrying roller 32 is rotated by a sub scanning direction motor 131 via a timing belt 132 and a timing pulley 133; with this, the carrying belt 31 of the sub scanning direction paper carrying section 3 is rotatably moved in the paper carrying direction (sub scanning direction) shown in FIG. 2. The carrying belt 31 has a double-layered structure which has a front layer that is a paper attaching face formed by pure resin to which rheostatic control is not applied, for example, an ETFE pure material, and a back layer (ground layer) formed by the same material of the front layer to which the rheostatic control is applied by carbon. However, the carrying belt 31 is not limited to the above structure and is able to have a single layer or a three-layered structure.

Further, an encoder wheel 137 having high resolution is attached to an axle 32*a* of the carrying roller 32, and a photosensor 138 of a transmission type for detecting a slit (not shown) formed in the encoder wheel 137 is disposed; with this, a rotary encoder is formed by the encoder wheel 137 and the photo-sensor 138.

The paper feeding section 4 is removable from the front side of the apparatus main body 1, and provides paper feeding cassettes 41 in each of which many pieces of paper 5 are stored; a paper feeding roller 42 and a friction pad 43 that feed the paper 5 by picking up each paper 5 from the paper feeding cassette 41; and registration rollers 44 that register the fed paper 5. In addition, the paper feeding section 4 provides a manual paper feeding tray 46 in which many pieces of paper 5 are stored, a paper feeding roller 47 that feeds the paper 5 by picking up each paper 5 from the manual paper feeding tray 46, a carrying roller 48 that carries the paper 5 fed from a paper feeding cassette (not shown), which is installed under the apparatus main body 1 as an option, and from the image forming on both sides unit 10. Rollers such as the paper feeding roller 42, the registration rollers 44, the paper feeding roller 47, and the carrying roller 48, which feed the paper 5 to the sub scanning direction paper carrying section 3, are rotatably driven by a paper feeding motor 49, which is a stepping motor of a HD type, via an electromagnetic clutch (not shown).

The paper outputting section 7 provides three paper outputting rollers 71*a*, 71*b*, and 71*c* (when those are not individually described, they are referred to as a paper outputting roller 71) that carry the paper 5 separated by the paper separation claw 38 of the sub scanning direction paper carrying section 3, and three spurs 72*a*, 72*b*, and 72*c* (when those are not individually described, they are referred to as a spur 72) that face the paper outputting roller 71. Further, the paper outputting section 7 provides a lower guiding section 73 and an upper guiding section 74 that guide the paper 5 being carried between the paper outputting roller 71 and the spur 72, and a pair of paper reversing rollers 77 and a pair of reversed paper outputting rollers 78 that carry the paper 5 being fed between the lower guiding section 73 and the upper guiding section 74 to the paper outputting tray 8 via a reversed paper outputting route 81, which is a first paper outputting route, in which the paper 5 is reversed. In addition, a carrying route, which carries the paper 5 between the lower guiding section 73 and the upper guiding section 74, is called a carrying route 70, and the length of the carrying route 70 is decided so that time for drying the paper 5 can be secured to a degree that wearing of the image does not occur even when the paper 5 is reversed and output.

At the outputting side of the carrying route 70, a branching mechanism 60 is disposed. The branching mechanism changes over a route to any one of the first paper outputting route 81 for reversing and outputting the paper 5 to the paper outputting tray 8, a second paper outputting route 82 for outputting the paper 5 to a paper straight outputting tray 181 (described below), and a paper outputting route (both sides forming route) for sending the paper 5 to the image forming on both sides unit 10.

On the side face of the apparatus main body 1, a vertical image forming on both sides of paper carrying route 83, which carries the paper 5 output from the branching mechanism 60 downward to the image forming on both sides unit 10, is disposed. On the vertical image forming on both sides of paper carrying route 83, a pair of input rollers 91 and a pair of output rollers 92 which carry the paper 5 downward are disposed. In addition, a guide plate 84 for forming the vertical image forming on both sides of paper carrying route 83 is disposed on the side part of the apparatus main body 1.

The image forming on both sides unit 10 provides a vertically carrying route 90*a*, which vertically carries the paper 5 input from the vertical image forming on both sides of paper carrying route 83, and a switchback carrying route 90*b*. In the vertically carrying route 90*a*, five pairs of both side rollers 93 are disposed. In the switch back carrying route 90*b*, a both sides output roller 94, which reverses the paper 5 fed from the vertically carrying route 90*a* and feeds the reversed paper 5, and three pairs of both sides carrying rollers 95 are disposed.

In addition, a branching plate 96, which changes over a carrying route of the paper 5 from the vertically carrying route 90*a* to the switchback carrying route 90*b* and changes over a carrying route from the switchback carrying route 90*b* to the carrying roller 48, is disposed in a manner so that the branching plate 96 can swing through an arc. The branching plate 96 can swing between a switchback side position shown by a continuous line in FIG. 1 and a re-supplying side position shown by a broken line in FIG. 1.

The paper 5 output from the image forming on both sides unit 10 is carried to the registration rollers 44 via the carrying roller 48.

In addition, in order to prevent back tension from being applied to the paper 5 by forming a loop in the paper 5 between the carrying roller 32 and the pushing rollers 36 of the sub scanning direction paper carrying section 3 and the registration rollers 44, when the paper 5 fed from the paper feeding cassette 41 in the paper feeding section 4, the manual paper feeding tray 46, or the image forming on both sides unit 10 is carried by the registration rollers 44, a switching guide plate 110 is disposed in the apparatus main body 1 in a manner so that the switching guide plate 110 can swing.

The switching guide plate 110 guides the paper 5 by swinging from the state shown in FIG. 1 in the arrow direction. When the paper 5 is carried from the registration rollers 44 to the sub scanning direction paper carrying section 3 and the switching guide plate 110 returns to the state shown in FIG. 1 at the timing when the paper 5 reaches the sub scanning direction paper carrying section 3, the switching guide plate 110 causes the paper 5 to form a loop thereon.

In addition, in the image forming apparatus, in order to manually feed a piece of paper, one paper manually feeding tray 141 is disposed in one side of the apparatus main body 1 in a manner so that the one paper manually feeding tray 141 can be opened and closed. When a piece of paper is fed, the one paper manually feeding tray 141 is opened to the position shown by a two-dot chain line. The paper 5 fed from the one paper manually feeding tray 141 can be inserted straight between the carrying roller 32 and the pushing rollers 36 of the sub scanning direction paper carrying section 3 by being guided by the upper face of the switching guide plate 110.

Further, in order to straightly output the paper 5 in a face-up state in which an image is formed by being applied to the one piece of paper manually fed, the paper straight outputting tray 181 is disposed in the other side of the apparatus main body 1 in a manner so that the paper straight outputting tray 181 can be opened and closed. When the paper straight outputting tray 181 is opened, the paper straight outputting route 82 being the second paper outputting route, which outputs in a straight manner the paper 5 fed from between the lower guiding section 73 and the upper guiding section 74, is formed.

With the above structure, when a thick medium such as an OHP sheet and a thick paper, which is difficult to be carried in a curved route, is used, the medium can be carried straight from the one paper manually feeding tray 141 to the paper straight outputting tray 181. In this, a normal paper can be carried straight from the one paper manually feeding tray 141 to the paper straight outputting tray 181 in the image forming process.

Next, image forming operations in the image forming apparatus are concisely explained. A high alternating voltage having positive and negative rectangular pulses is applied to the charging roller 34 from an AC bias voltage supplying section (not shown). Since the charging roller 34 contacts an insulation layer (upper face) of the carrying belt 31, positive and negative electric charges are alternately applied in the carrying direction of the carrying belt 31 in a belt state on the upper face of the carrying belt 31. With this, a non-uniform electric field is generated on the carrying belt 31 by being charged in a predetermined charging width.

The paper 5, fed from the paper feeding section 4, the manual paper feeding tray 46, the image forming on both sides unit 10, or the one paper manually feeding tray 141, is carried on the carrying belt 31, in which the non-uniform electric field is generated by the positive and negative electric charges, between the carrying roller 32 and the pushing rollers 36. The paper 5 is instantaneously polarized corresponding to the direction of the electric field, is attached on the carrying belt 31 by electrostatic force, and is carried based on the movement of the carrying belt 31.

The paper 5 is intermittently carried by the carrying belt 31, and an image is formed (printed) on the paper 5 by ejecting ink droplets of recording liquid from the recording head 24 based on recording data. The tip of the paper 5 is separated from the carrying belt 31 by the paper separating claw 38. With this, the paper 5 in which the image is formed is separated from the carrying belt 31. The paper 5 is carried to the paper outputting tray 8, the paper straight outputting tray 181, or the image forming on both sides unit 10 by the paper outputting section 7. When the paper 5 is carried to the image forming on both sides unit 10, an image is formed on the other side of the paper 5 and the paper 5 is output.

Figure 4:
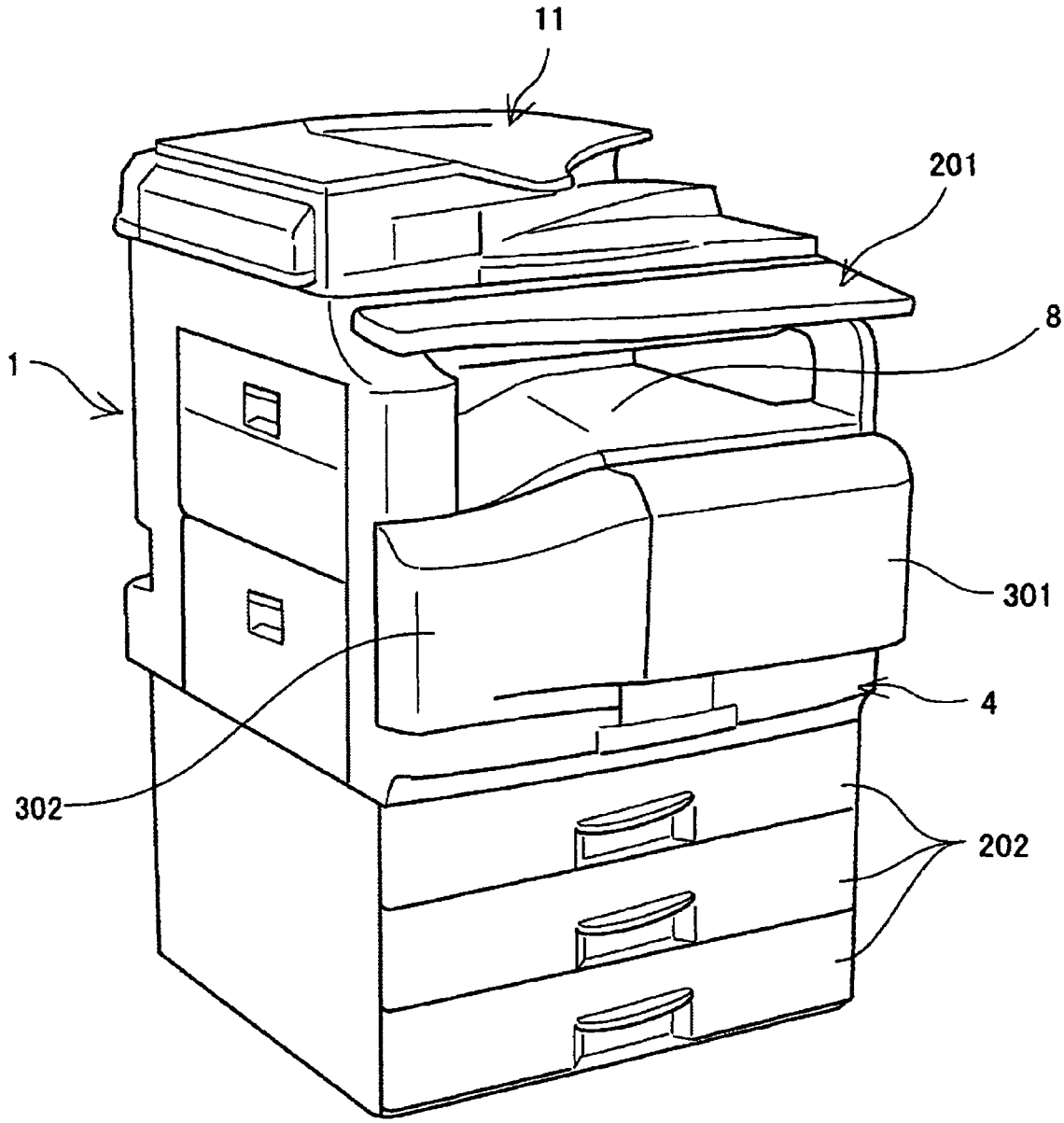
FIG. 4 is a perspective view of the appearance of the image forming apparatus according to the embodiment of the present invention.
Figure 5:
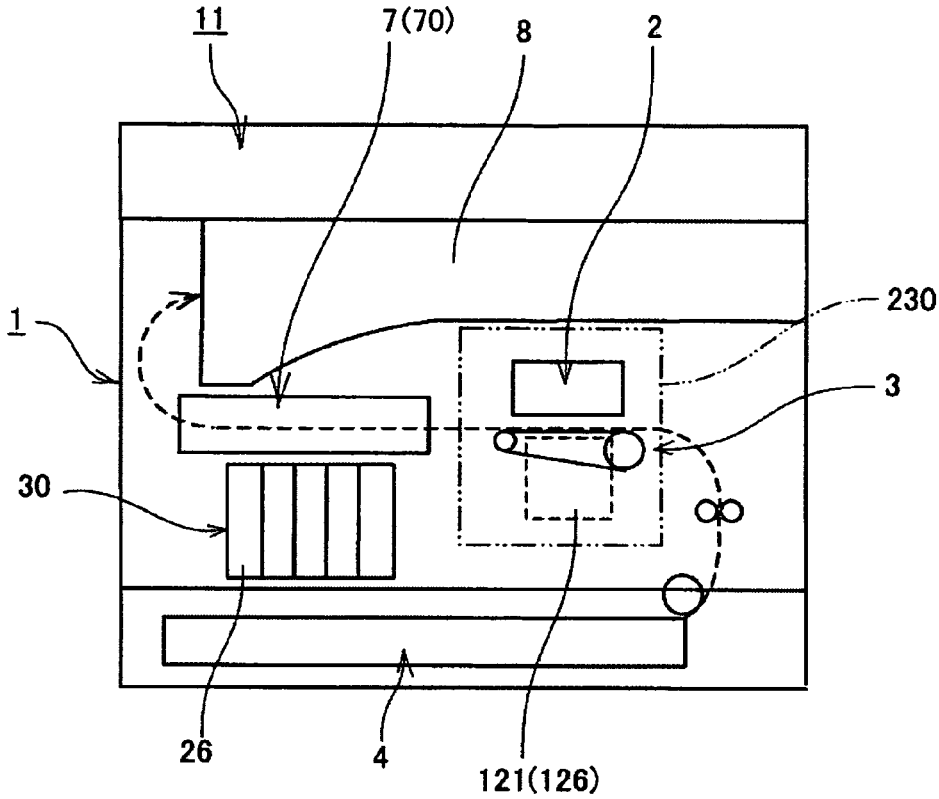
FIG. 5 is a schematic front view showing a layout of structural elements of the image forming apparatus shown in FIG. 4.
Figure 6:
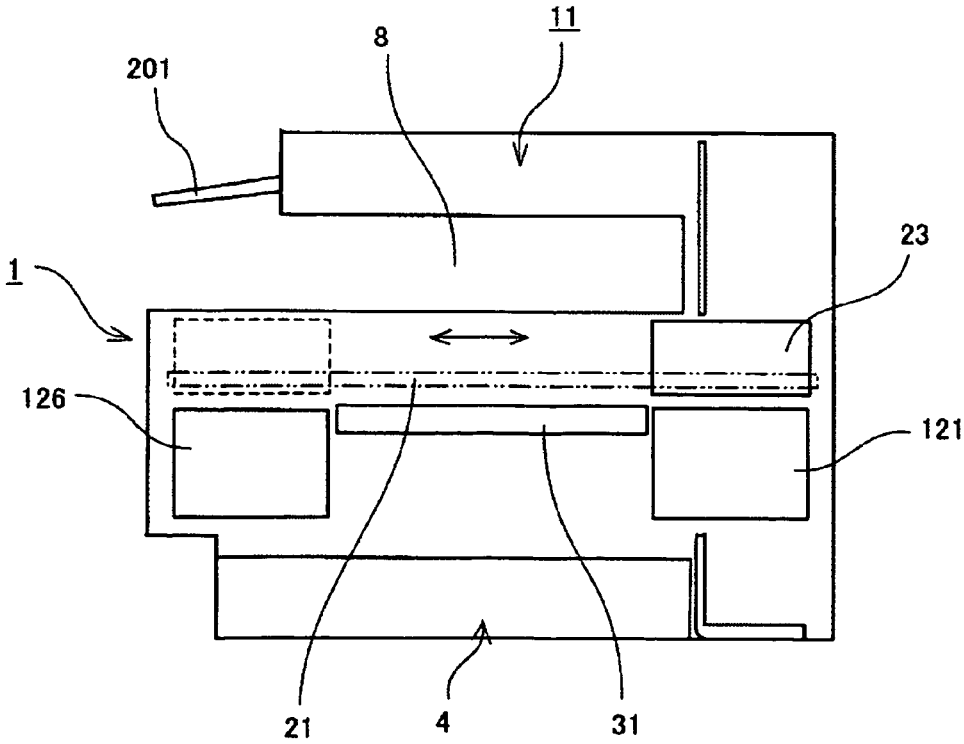
FIG. 6 is a schematic side view of the image forming apparatus shown in FIG. 4.
Figure 7:
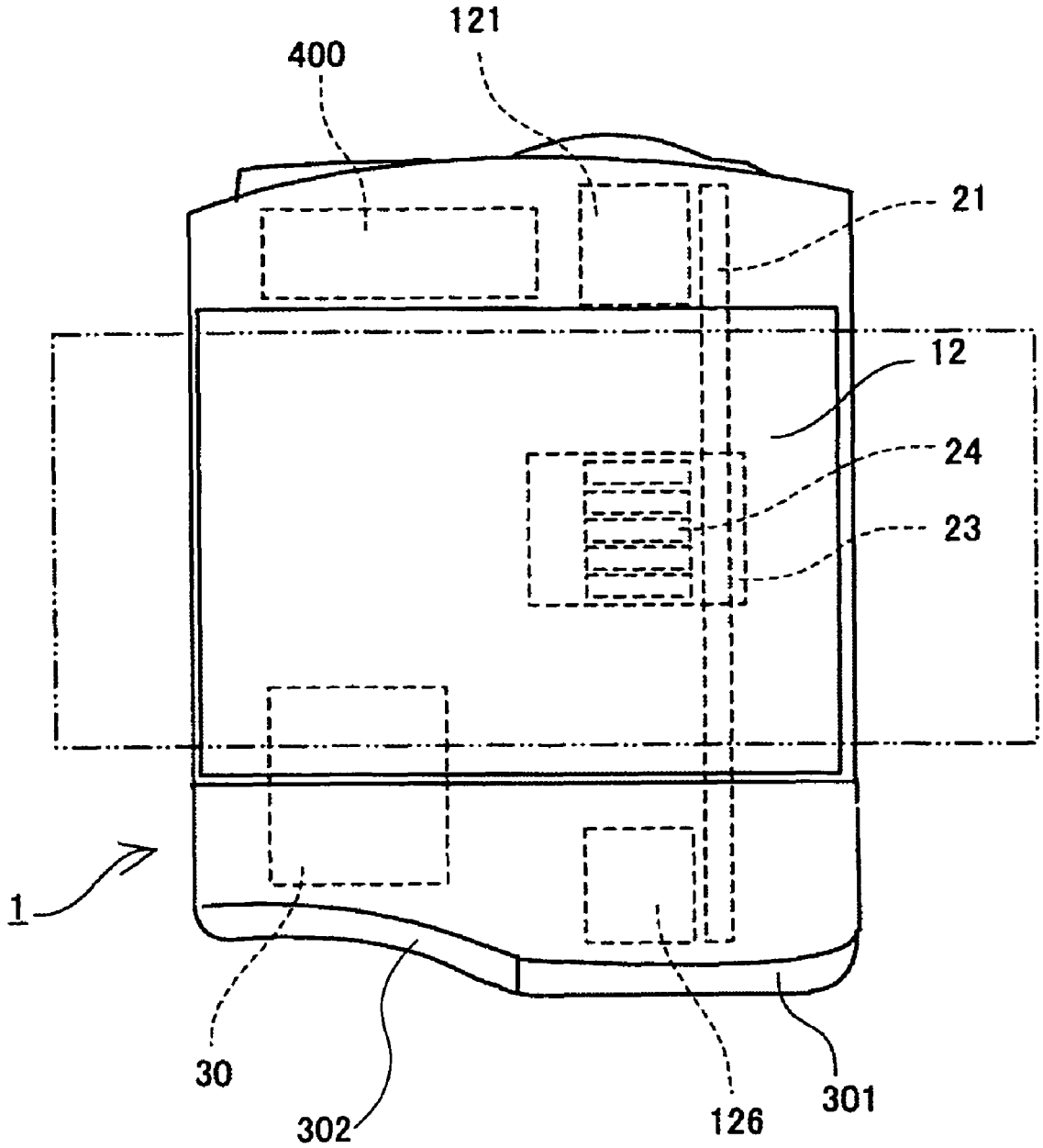
FIG. 7 is a schematic plan view of the image forming apparatus shown in FIG. 4.
Figure 8:
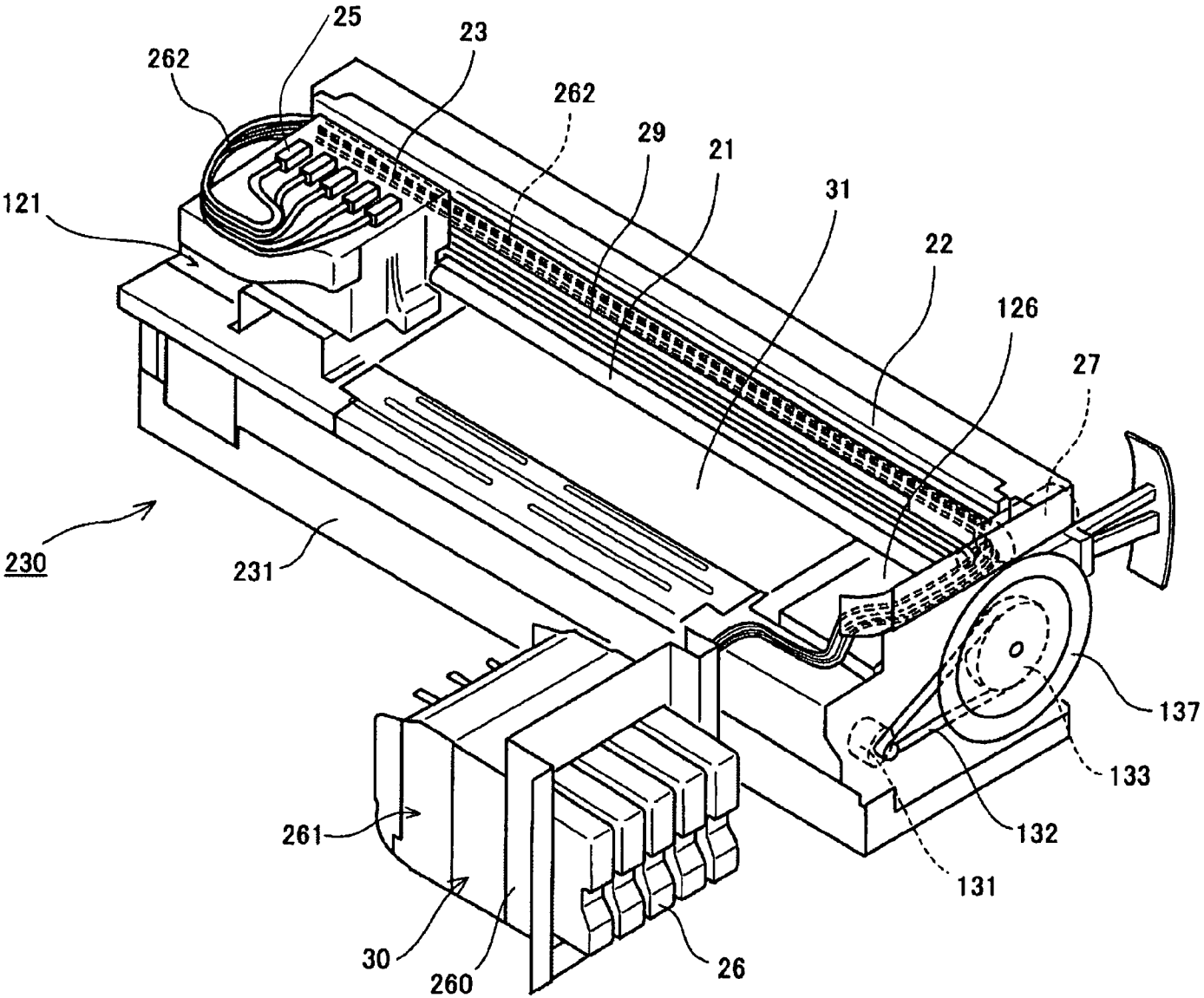
FIG. 8 is a perspective view of an engine unit of the image forming apparatus shown in FIG. 4.

Next, referring to FIGS. 4 through 8, the disposition of structural elements in the image forming apparatus is further explained. FIG. 4 is a perspective view of the appearance of the image forming apparatus according to the embodiment of the present invention. FIG. 5 is a schematic front view showing a layout of structural elements of the image forming apparatus shown in FIG. 4. FIG. 6 is a schematic side view of the image forming apparatus shown in FIG. 4. FIG. 7 is a schematic plan view of the image forming apparatus shown in FIG. 4. FIG. 8 is a perspective view of an engine unit of the image forming apparatus shown in FIG. 4.

In the image forming apparatus, the image forming section 2 and the sub scanning direction paper carrying section 3 are integrated to form an engine unit 230 (refer to FIG. 8). The apparatus main body 1 provides the engine unit 230, the paper feeding section 4, the paper outputting section 7, the image reading section 11, and so on. The paper outputting tray 8 for outputting the paper 5 is disposed in the upper position of the apparatus main body 1. On the front side of the apparatus main body 1 and above the paper outputting section 8, an operating section 201 (operations panel or operating board) is disposed. Predetermined instructions are given to the apparatus main body 1, the image reading section 11, and so on, from the operating section 201; further, predetermined information is displayed on the operating section 201. The operating section 201 is disposed to be able to swing, that is, the operating section 201 is a tilt type. The image forming apparatus is a front operating type. Further, the image forming apparatus shown in FIG. 4 provides plural additional paper feeding trays 202 for storing many pieces of paper instead of disposing the image forming on both sides unit 10.

In addition, the image forming apparatus provides a right front cover 301 which can be opened to removably attach the engine unit 230 (the image forming section 2 and the sub scanning direction paper carrying section 3) to the apparatus main body 1 and a left front cover 302 which can be opened to change the ink cartridge 26 in the ink cartridge storing section 30 in the front side of the apparatus main body 1. When the right front cover 301 and the left front cover 302 are viewed from above the apparatus main body 1, as shown in FIG. 7, the right front cover 301 behind which the remaining ink droplet receiving member 126 is disposed slightly protrudes and the left front cover 302 behind which the ink cartridge storing section 30 is disposed relatively retracts. With this, the area of the apparatus main body 1 in the plan view is made small.

As shown in FIG. 5, in the apparatus main body 1, the engine unit 230 is disposed at the right side (at the left side when being viewed from the other side) in the apparatus main body 1, and the paper outputting section 7 having the carrying route 70, which carries the paper 5 straight in which an image is formed by the engine unit 230, is disposed at the left side of the engine unit 230. Further, the ink cartridge storing section 30 to which the ink cartridge 26 being a recording liquid cartridge is removably attached is disposed under the paper outputting section 7.

Since the carrying route 70 of the paper outputting section 7, which carries the paper 5 straight in which an image is formed by the engine unit 230 soon after the image is formed, is disposed in the apparatus main body 1, time for the recording liquid to dry on the paper 5 to which recording liquid (ink) is jetted so as to form an image can be obtained. With this, lowering of image quality on the paper 5 caused by wearing of the image while being carried to the paper outputting tray 8 can be prevented.

That is, when the paper 5 is output by being reversed soon after the image is formed on the paper 5, the face on which the image is formed must be held by rollers and so on before the recording liquid on the paper 5 is sufficiently dried. Consequently, wearing of the image is likely to occur and this causes lower image quality. However, in the image forming apparatus, the paper outputting section 7, which carries the image formed paper 5 straight soon after the image is formed while keeping the image formed face upward, is disposed in the apparatus main body 1. Therefore, time to dry the recording liquid on the paper 5 can be sufficiently obtained, and after this, even when the paper 5 is reversed, the wearing on the image formed face does not occur and lowering the image quality can be prevented.

Further, since the ink cartridge storing section 30 in which the ink cartridge 26 is stored is disposed under the paper outputting section 7, the space in the apparatus main body 1 can be effectively utilized and the space in the length direction of the apparatus main body 1 can be made small.

That is, in an image forming apparatus of a serial scan type, in order to maintain and recover the recording head 24, the nozzle maintaining and recovering unit 121 and the remaining ink droplet receiving member 126 are required. Consequently, the scanning region of the carriage 23 must be wider than the width of paper which can pass through. In a structure in which the scanning direction of the carriage 23 is the front and back directions of the apparatus main body 1, for example, the nozzle maintaining and recovering unit 121 is disposed at the back side and the remaining ink droplet receiving member 126 is disposed at the front side.

In an image forming apparatus having a structure in which an ink tank (ink cartridge) is stored in a carriage, there is no need to additionally dispose an ink cartridge storing section in an apparatus main body. However, in the image forming apparatus of a sub tank type, the ink cartridge storing section 30 in which the ink cartridge 26 is stored must be disposed in the apparatus main body 1. When the ink cartridge storing section 30 is disposed under the engine unit 230, and the nozzle maintaining and recovering unit 121 and the remaining ink droplet receiving member 126 are disposed at both sides of the main scanning direction of the carriage 23, the height of the apparatus main body 1 becomes unnecessarily large. In addition, in the above image forming apparatus, when the engine unit 230 is removably attached to the apparatus main body 1, the ink cartridge storing section 30 cannot be disposed at the front side of the engine unit 230.

In order to solve these problems, as shown in FIG. 5, when the ink cartridge storing section 30 is disposed in a space at the side of the engine unit 230 and under the paper outputting section 7 as viewed from the front of the apparatus main body 1, the ink cartridge storing section 30 can be disposed without making the height and the width of the apparatus main body 1 large. Further, as shown in FIG. 7, when the ink cartridge storing section 30 is disposed so that a part of the ink cartridge storing section 30 is disposed inside the maximum passing paper width looked from above the apparatus main body 1, the occupying space of the apparatus main body 1 in the front and back direction can be made small. In addition, when the paper outputting section 7 is disposed to obtain drying time of the recording liquid on the paper 5, a space under the paper outputting section 7 can be effectively utilized.

In the image forming apparatus, as shown in FIG. 7, the ink cartridge storing section 30 is disposed in the front side of the apparatus main body 1 and an electric component section 400 including a heat generating component is disposed in the back side facing the ink cartridge storing section 30 of the apparatus main body 1.

In the image forming apparatus, heat generating from electric components such as a power source and a control printed circuit board cannot be avoided. However, when the electric component section 400 is disposed under the nozzle maintaining and recovering unit 121 using the recording liquid in the image forming section 2, since heat generating from the electric component section 400 naturally rises, the nozzle maintaining and recovering unit 121 and the recording head 24 staying at the position are heated, drying of the recording liquid is facilitated, and closing of a nozzle of the recording head 24 is likely to occur.

In the image forming apparatus, a space formed by a shuttle type, in which the nozzle maintaining and recovering unit 121 and the remaining ink droplet receiving member 126 must be disposed at both sides of the main scanning direction, is effectively utilized. In order to make the heat influence to the nozzle maintaining and recovering unit 121 of the image forming section 2 low, the electric component section 400 including a heat generating component is disposed in the back side of the apparatus main body 1 facing the ink cartridge storing section 30 and at the side of the nozzle maintaining and recovering unit 121. In this case, it is preferable that the electric component section 400 include at least the power source and the control printed circuit board which are likely to generate heat.

Next, the engine unit 230 is explained in more detail. As described above, the engine unit 230 is formed by integrating the image forming section 2 and the sub scanning direction paper carrying section 3 and is removably attached to the apparatus main body 1. With this, the maintainability is improved. Further, as shown in FIG. 8, the ink cartridge storing section 30, to which the ink cartridge 26 for supplying ink to the sub tank 25 on the carriage 23 of the image forming section 2 is removably stored, is attached to the engine unit 230 in an integrated manner.

As described above, since the image forming apparatus is the sub tank type apparatus, in order to refill the sub tank 25 on the carriage 23 with ink from the ink cartridge 26 in the apparatus main body 1, the ink cartridge storing section 30 provides a frame 260 for holding the ink cartridge 26 and an ink supplying member 261 for supplying ink in the ink cartridge 26 to the sub tank 25. Ink is supplied to the sub tank 25 on the carriage 23 via a recording liquid tube 262 from the ink supplying member 261. In this, specifically, five sub tanks 25 are provided on the carriage 23 and five recording liquid tubes 262 are provided to connect to five ink cartridges 26.

In addition, one unit is formed by integrating the ink cartridge storing section 30 storing the ink cartridge 26 and the engine unit 230 by fixing the frame 260 of the ink cartridge storing section 30 to a frame 231 of the engine unit 230. When the engine unit 230 is removed from the apparatus main body 1, the engine unit 230 can be removed together with the ink cartridge storing section 30 from the apparatus main body 1 without disassembling an ink supplying mechanism from the ink cartridge storing section 30 including the ink cartridge 26 to the sub tank 25 on the carriage 23 via the recording liquid tube 262. With this, inability to supply ink to the sub tank 25 from the ink cartridge 26 caused by closing the ink supplying mechanism due to entering dust or air in the ink supplying mechanism can be prevented.

Figure 9:
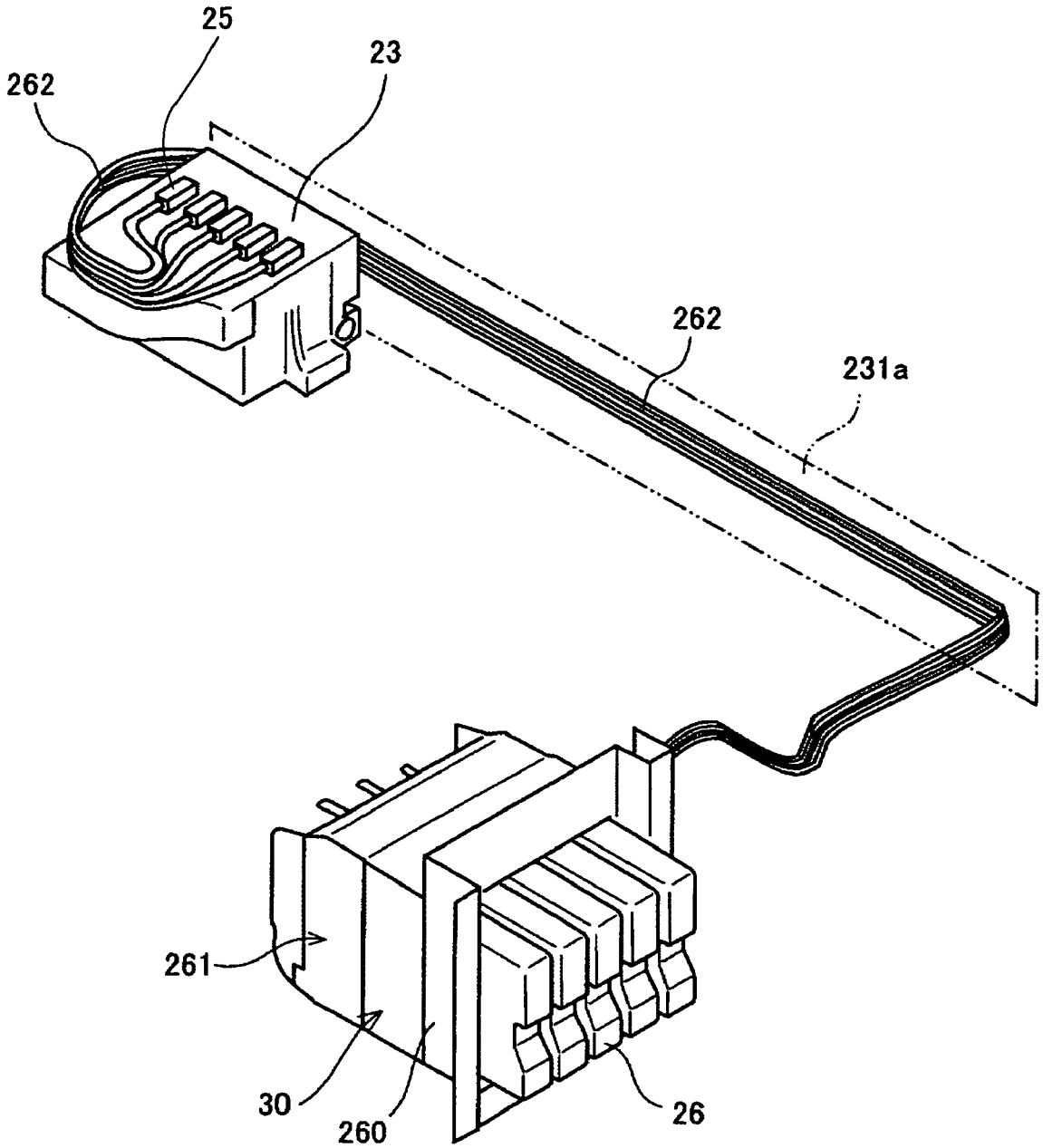
FIG. 9 is a perspective view showing an ink supplying mechanism according to the embodiment of the present invention.

When the frame 231 of the engine unit 230 is removed from the frame 260 of the ink cartridge storing section 30, and further the guide rod 21 is pulled out, as shown in FIG. 9, the ink cartridge storing section 30, the frame 260, the ink supplying member 261, the recording liquid tube 262, the carriage 23 including the recording head 24 and the sub tank 25 can be removed as one unit, that is, the ink supplying mechanism can be changed as one unit. In this, FIG. 9 is a perspective view showing the ink supplying mechanism according to the embodiment of the present invention.

By the above, when the ink supplying mechanism is changed, inability to supply ink caused by closing the ink supplying mechanism due to entering air or dust in the ink supplying mechanism can be prevented. With this, maintainability and assemble-ability can be improved. In addition, under normal conditions, since the ink cartridge tube 262 is not directly connected to the ink cartridge 26, when the ink cartridge 26 is changed, air or dust does not enter the recording liquid tube 262. Further, when only the recording head 24 is changed instead of changing the carriage 23 including the recording head 24, the positional relationship between the carrying belt 31 and the recording head 24 and the mutual positions of the recording heads 24 are changed; with this, reproducibility of an image may be degraded.

As shown in FIG. 9, the recording liquid tube 262 connecting from the ink cartridge storing section 30 to the sub tank 25 on the carriage 23 is disposed along a back plate 231*a* (a frame member outside the main scanning region) of the frame 231 of the engine unit 230 and an opening space is formed above the carrying belt 31 (not shown) of the sub scanning direction paper carrying section 3.

Therefore, when jamming occurs in the sub scanning direction paper carrying section 3, even if the carriage 23 stays at the home position (above the nozzle maintaining and recovering unit 121), since the recording liquid tube 262 does not exist above the sub scanning direction paper carrying section 3, a process solving the jamming can be easily executed.

Figure 10:
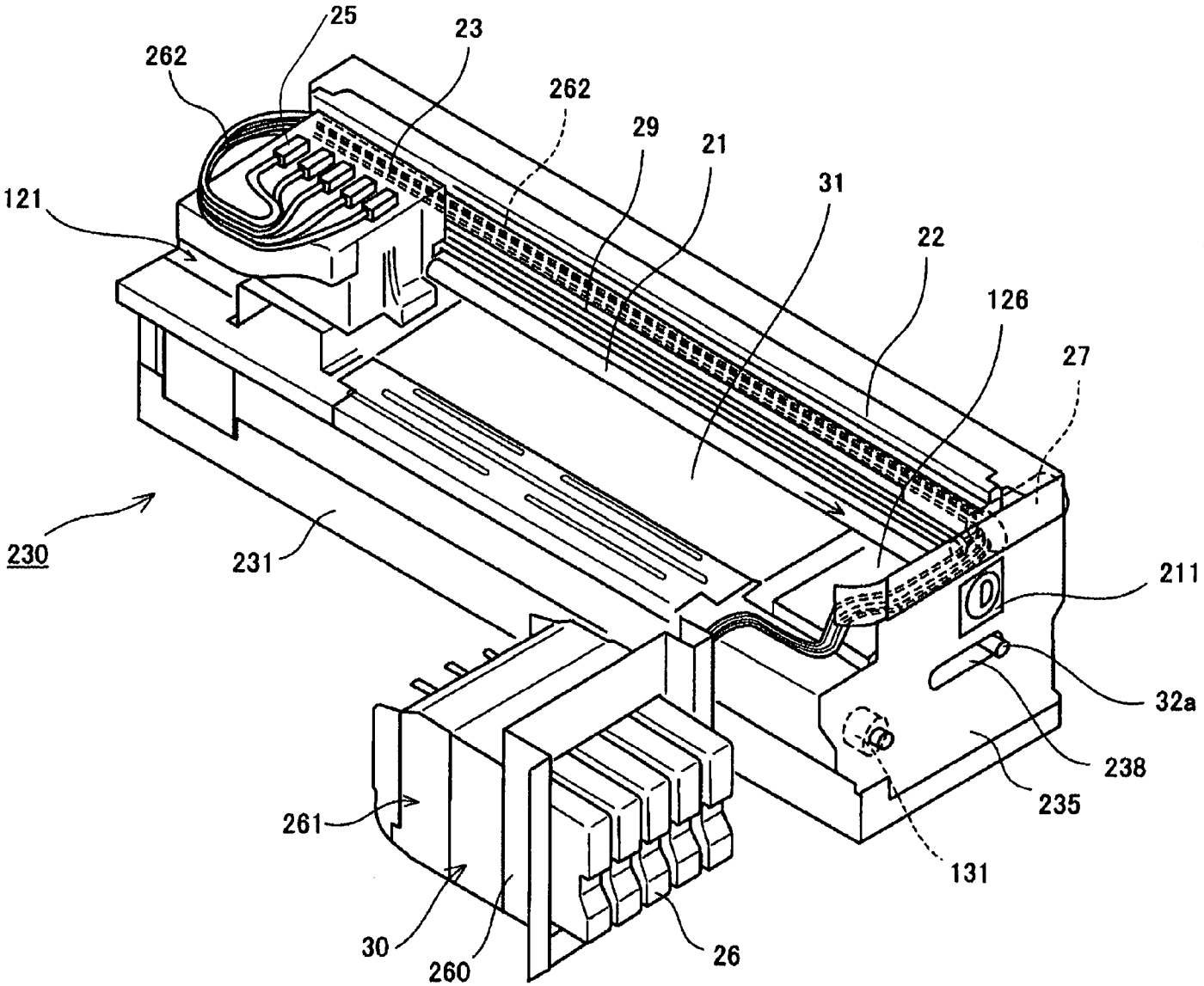
FIG. 10 is a perspective view showing processes to pull out a guide rod from the engine unit according to the embodiment of the present invention.

FIG. 10 is a perspective view showing processes to pull out the guide rod 21 from the engine unit 230 according to the embodiment of the present invention. Referring to FIG. 10, the processes for pulling out the guide rod 21 from the engine unit 230 are explained. First, the encoder wheel 137 (not shown) and the timing pulley 133 (not shown) disposed outside a side plate 235 are removed (described below in detail), a holding member 211 of the side plate 235 holding the end of the guide rod 21 is removed, and the guide rod 21 is pulled out in the arrow direction. With this, the guide rod 21 is removed from the carriage 23. Even when the guide rod 21 is removed, the carriage 23 is sustained by the nozzle maintaining and recovering unit 121.

Figure 11:
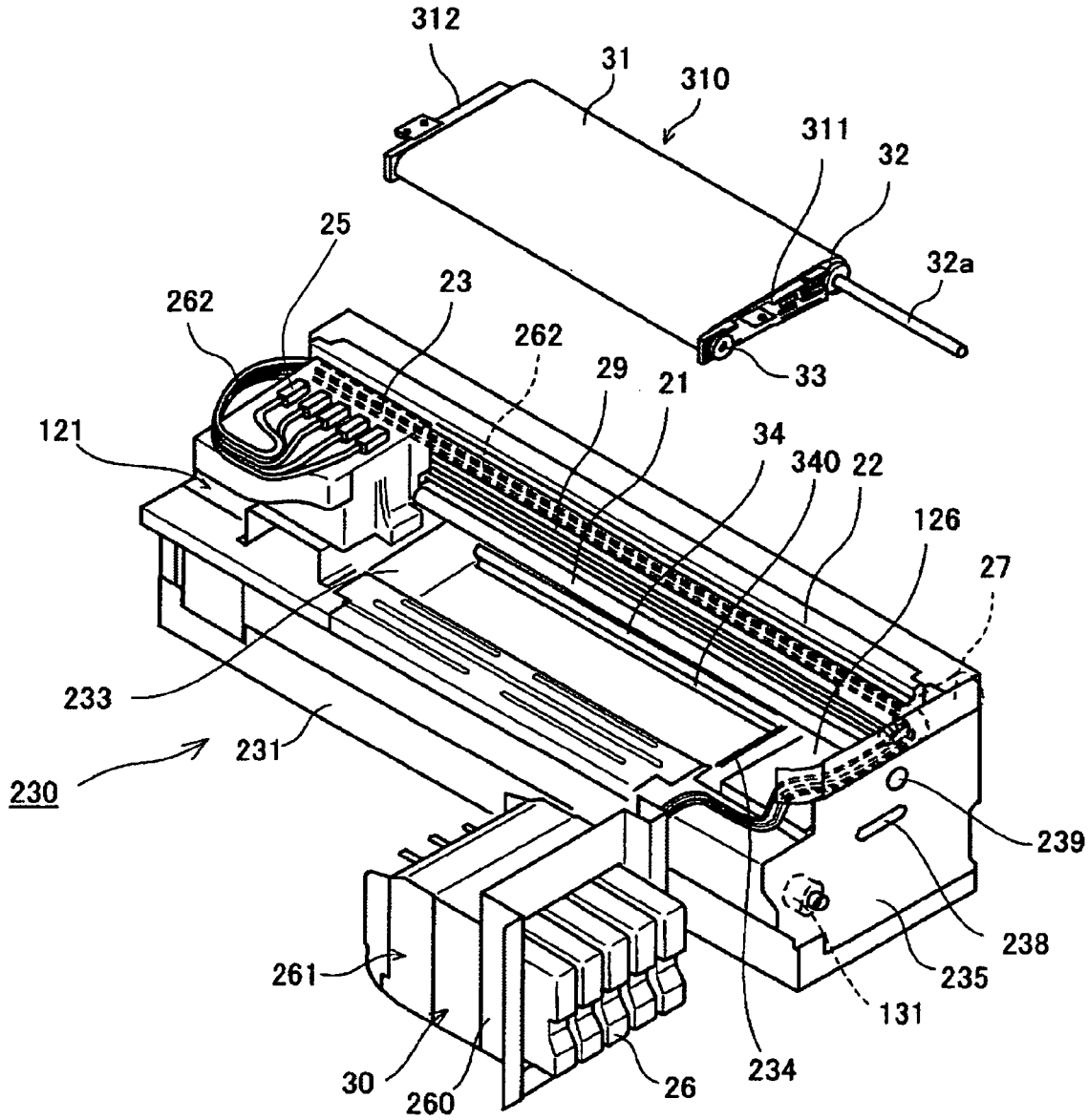
FIG. 11 is a perspective view showing the engine unit in which a carrying unit is removed according to the embodiment of the present invention.

FIG. 11 is a perspective view showing the engine unit 230 in which a carrying unit is removed according to the embodiment of the present invention. In the engine unit 230, a carrying unit 310 is formed by integrating the carrying belt 31, the carrying roller 32 holding the carrying belt 31 and the driven roller 33. As shown in FIG. 11, the carrying unit 310 is removably attached to the engine unit 230 without removing the guide rod 21 which is a guide member for guiding the carriage 23.

Referring to FIGS. 12 through 17, processes to remove the carrying unit 310 from the engine unit 230 are explained in detail.

First, holders 311 and 312 holding the carrying roller 32, the driven roller 33, and so on of the carrying unit 310 are removed from side plates 234 and 233, respectively, of the engine unit 230 (refer to FIG. 11).

Figure 12:
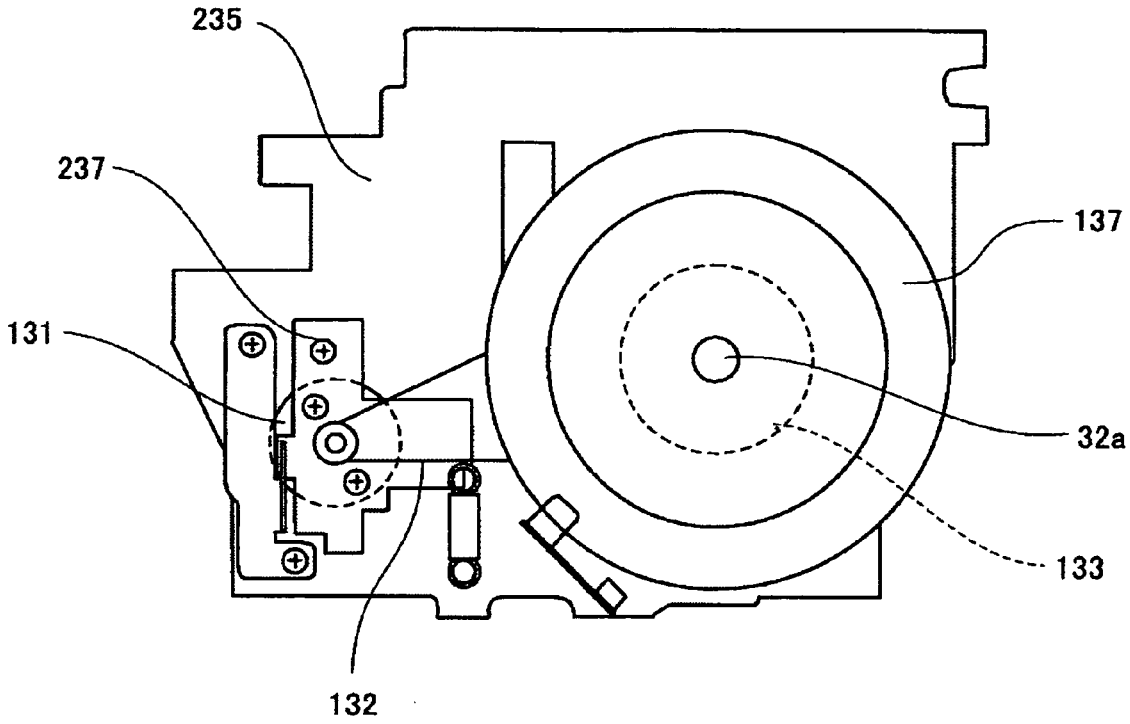
FIG. 12 is a diagram showing a first process to remove the carrying unit from the engine unit according to the embodiment of the present invention.
Figure 13:
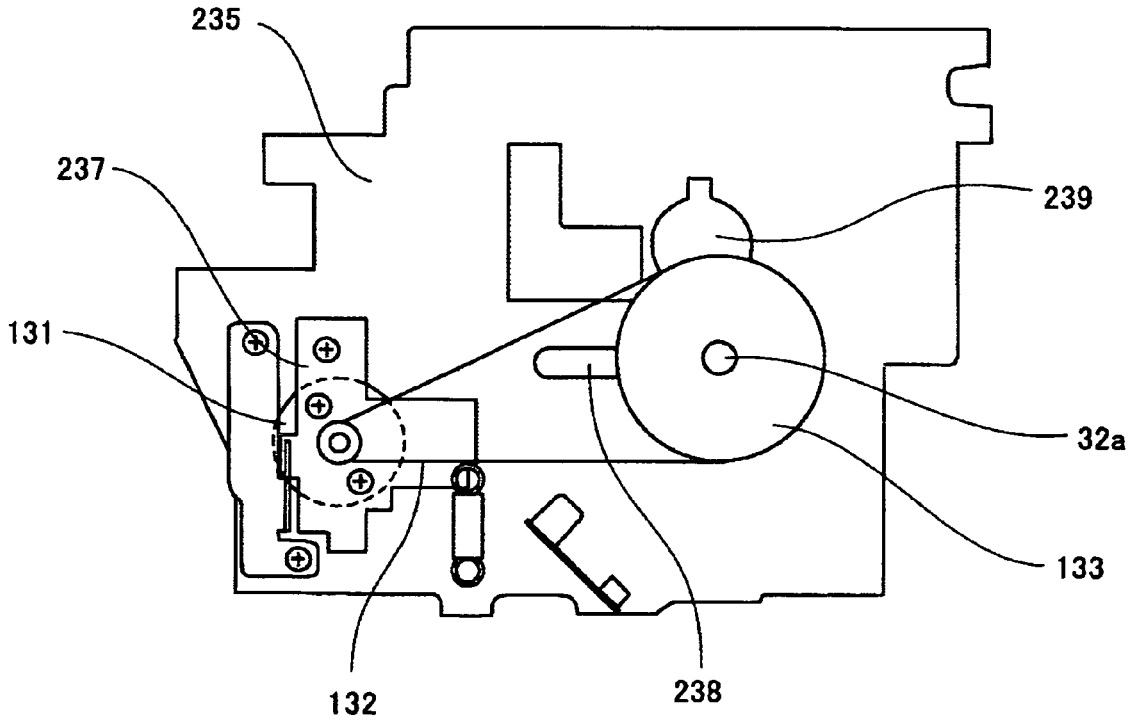
FIG. 13 is a diagram showing a second process to remove the carrying unit from the engine unit according to the embodiment of the present invention.
Figure 14:
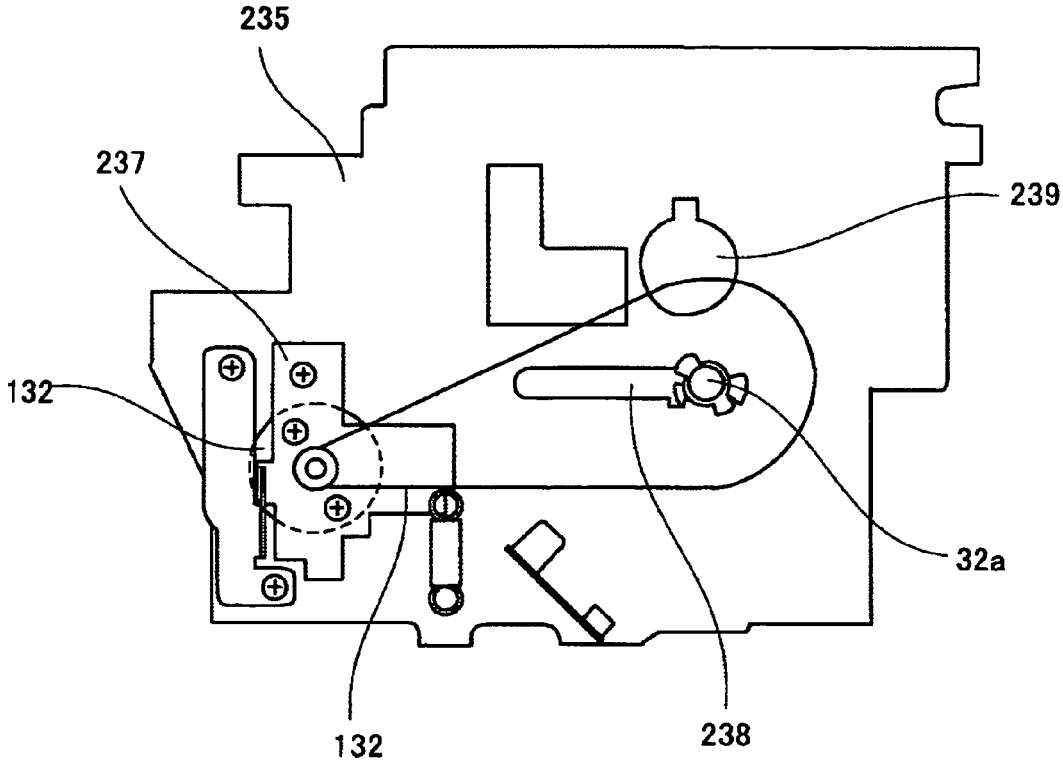
FIG. 14 is a diagram showing a third process to remove the carrying unit from the engine unit according to the embodiment of the present invention.

FIG. 12 is a diagram showing a first process to remove the carrying unit 310 from the engine unit 230 according to the embodiment of the present invention. In FIG. 12, the encoder wheel 137 is attached to the axle 32*a* of the carrying roller 32 of the carrying unit 310 at the outside of the side plate 235. FIG. 13 is a diagram showing a second process to remove the carrying unit 310 from the engine unit 230 according to the embodiment of the present invention. As shown in FIG. 13, the encoder wheel 137 is removed from the axle 32*a* of the carrying roller 32, a screw of a motor bracket 237 to which the sub scanning direction motor 131 is attached is loosened, and the timing belt 132 is loosened from the timing roller 133. FIG. 14 is a diagram showing a third process to remove the carrying unit 310 from the engine unit 230 according to the embodiment of the present invention. As shown in FIG. 14, the timing roller 133 is removed from the axle 32*a* of the carrying roller 32.

Figure 15:
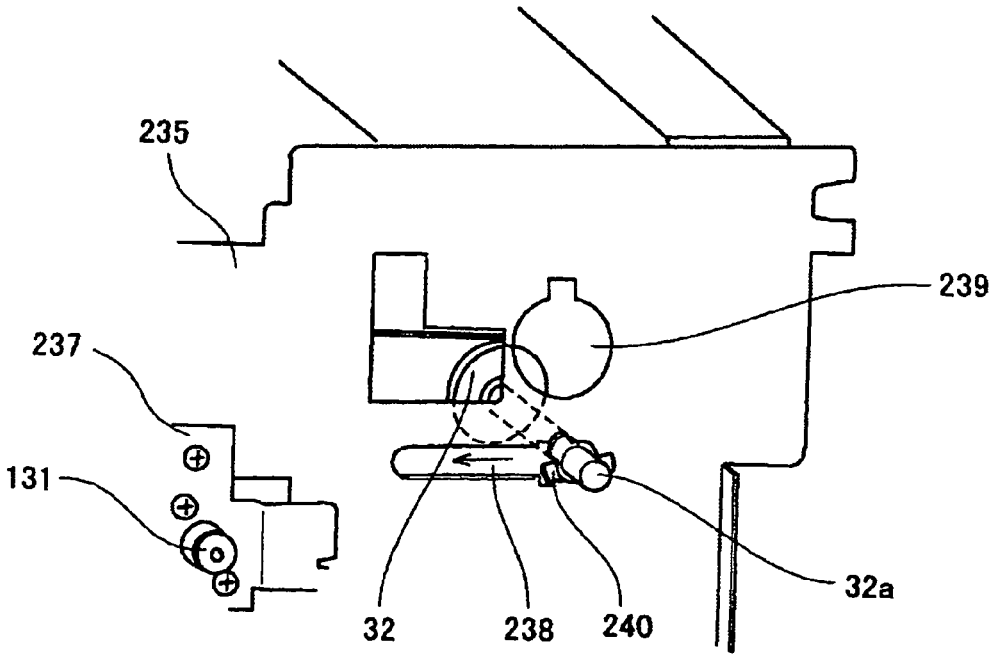
FIG. 15 is a perspective view showing a fourth process to remove the carrying unit from the engine unit according to the embodiment of the present invention.
Figure 16:
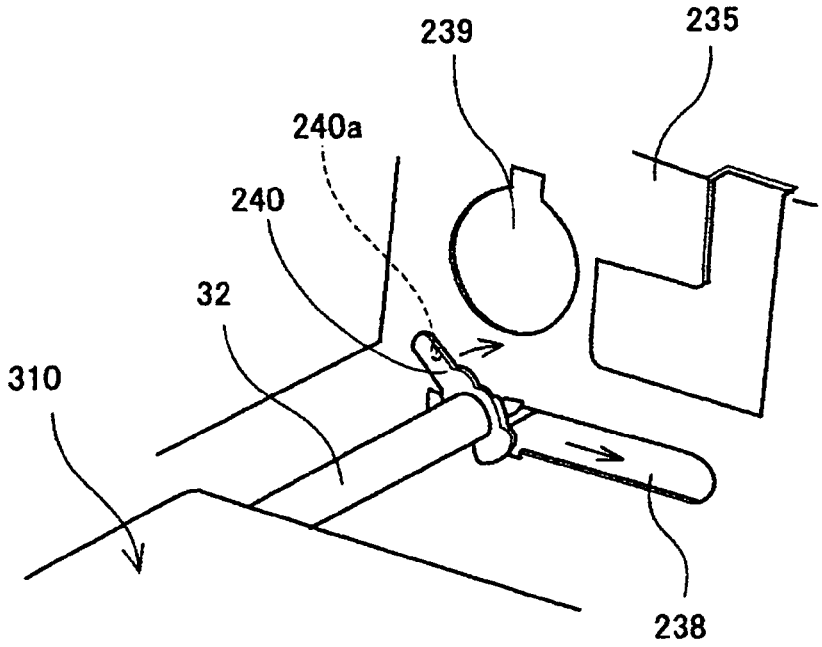
FIG. 16 is a perspective view showing the fourth process looking from the opposite side of that shown in FIG. 15.
Figure 17:
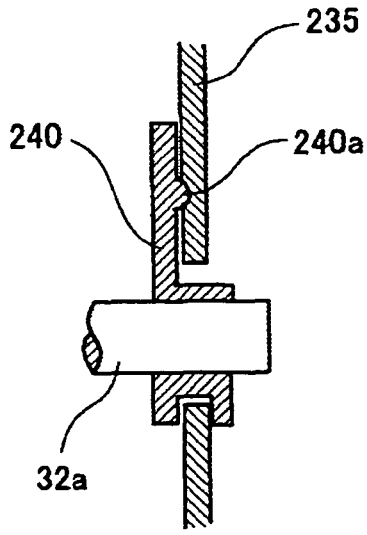
FIG. 17 is a cross-sectional view showing a part where a holding member holding an axle of a carrying roller is held by a side plate according to the embodiment of the present invention.

FIG. 15 is a perspective view showing a fourth process to remove the carrying unit 310 from the engine unit 230 according to the embodiment of the present invention. FIG. 16 is a perspective view showing the fourth process looking from the opposite side of that shown in FIG. 15. FIG. 17 is a cross-sectional view showing a part where a holding member holding the axle 32*a* of the carrying roller 32 is held by the side plate 235.

Referring to FIGS. 15 through 17, the fourth process is explained. As shown in FIG. 16, a convex part 240*a* of a holding member 240 is rotated in the arrow direction shown at the holding member 240 and the engagement with side plate 235 is released. Further, the axle 32*a* of the carrying roller 32 is moved along an elongated hole 238 formed in the side plate 235 in the arrow direction shown in the elongated hole 238. Then, the axle 32*a* can be removed from the elongated hole 238 and also the holding member 240 can be removed from the axle 32*a*. At this time, the position of the carrying unit 310 is moved to keep away from a rod hole 239 for holding the guide rod 21 of the side plate 235, that is, from the guide rod 21. After this, the axle 32*a* is removed from the elongated hole 238 and also the holding member 240 is removed from the axle 32*a*. With this, as shown in FIG. 11, the carrying unit 310 is removed from the engine unit 230.

As described above, since the elongated hole 238 is formed in the side plate 235 for holding the axle 32*a* of the carrying roller 32 of the carrying unit 310, the carrying unit 310 can be moved in the paper carrying direction, and the carrying unit 310 can be removed from the engine unit 230 without removing the guide rod 21. With this, maintainability and assemble-ability can be improved.

Since the encoder wheel 137 for detecting the moving amount of the carrying belt 31 is attached to the axle 32*a* of the carrying roller 32 outside the side plate 235 of the frame 231 of the engine unit 230, the encoder wheel 137 does not obstruct to remove the carrying unit 310.

As described above, since the carrying unit 310 including the carrying belt 31 for carrying a medium on which an image is formed is removably attached to the engine unit 230, maintainability and assemble-ability can be improved. Further, the carrying unit 310 of the engine unit 230 is removably disposed at a position where the guide rod 21 does not exist when the carrying unit 310 is removed. Therefore, the carrying unit 310 can be removed without disassembling the engine unit 230 (main direction moving mechanism). With this, maintainability and assemble-ability can be further improved.

Further, since the carrying unit 310 is removed as one unit, as shown in FIG. 11, the charging roller 34 that is held by the holder 240 (not shown) between the side plates 233 and 234 can be also removed. Therefore, the charging roller 34 can be easily changed.

Further, the present invention is not limited to the specifically disclosed embodiment, and variations and modifications may be made without departing from the scope of the present invention.

The present invention is based on Japanese Priority Patent Application No. 2005-048336, filed on Feb. 24, 2005, with the Japanese Patent Office, the entire contents of which are hereby incorporated by reference.

What is claimed is:

1. An image forming apparatus, comprising:

a main body having a front side and a back side;

an operating section disposed on the front side of the main body;

an engine unit having a frame and configured to form an image on a recording medium by moving a carriage in a main scanning direction between the front and back sides of the main body and by transporting the recording medium in a sub scanning direction which is perpendicular to the main scanning direction, wherein the carriage includes a recording head having nozzles configured to eject droplets of recording liquid and a sub tank configured to supply the recording liquid to the recording head, the engine unit being removable from and attachable to the main body in a direction parallel to the main scanning direction;

a nozzle maintaining and recovering unit provided in the engine unit and disposed at the back side of the main body, the nozzle maintaining and recovering unit being configured to maintain a normal state of the nozzles of the recording head and to recover from an abnormal state thereof; and a recording liquid supplying mechanism configured to supply the recording liquid to the recording head, wherein the recording liquid supplying mechanism includes the sub tank, a recording liquid cartridge configured to supply the recording liquid to the sub tank via at least one recording liquid tube, and a cartridge storing unit disposed at the front side of the main body relative to the nozzle maintaining and recovering unit and configured to store the recording liquid cartridge such that the recording liquid cartridge is removable from and attachable to the cartridge storing unit in a direction parallel to the main scanning direction, the engine unit includes a guide rod configured to guide the carriage in the main scanning direction, and the frame, the carriage and the guide rod are removable from the main body as a single unit by being pulled towards the front side of the main body, the nozzle maintaining and recovering unit is removable together with the engine unit by being pulled towards the front side of the main body in a state where the carriage is disposed at a position opposing the nozzle maintaining and recovering unit at the back side of the main body, and the recording liquid cartridge is removable from the cartridge storing unit by being pulled towards the front side of the main body.

2. The image forming apparatus as claimed in claim 1, wherein the cartridge storing unit has a frame configured to receive the recording liquid cartridge, and the at least one recording liquid tube is disposed inside the frame of the cartridge storing unit outside the main scanning region of the carriage of the engine unit.

3. The image forming apparatus as claimed in claim 1, wherein:

the engine unit has a transport unit that is removable from and attachable to the engine unit, the transport unit has transport members that include a transport belt configured to transport the recording medium in the sub scanning direction, and the transport members are integrated as a single unit.

4. The image forming apparatus as claimed in claim 3, wherein the transport unit of the engine unit is movable and provided at a position avoiding all the guide rod which guides the carriage in the main scanning direction when the transport unit is removed from or attached to the engine unit.

5. The image forming apparatus as claimed in claim 3, wherein the at least one recording liquid tube is disposed outside a main scanning region of the carriage of the engine unit, so that a space is formed above the portion of the transport belt confronting the recording head.

6. The image forming apparatus as claimed in claim 1, further comprising:

an outputting unit disposed on a side of the engine unit and configured to output the recording medium on which the image is formed by the engine unit to an outside of the image forming apparatus, wherein the cartridge storing part is disposed within a space under the outputting unit.

7. The image forming apparatus as claimed in claim 1, wherein the recording liquid supplying mechanism excludes the nozzle maintaining and recovering unit and a remaining droplet receiving member.

8. An image forming apparatus, comprising:

a main body having a front side and a back side;

an operating section disposed on the front side of the main body;

an engine unit having a frame and configured to form an image on a recording medium by moving a carriage in a main scanning direction between the front and back sides of the main body and by transporting the recording medium in a sub scanning direction which is perpendicular to the main scanning direction, wherein the carriage includes a recording head having nozzles configured to eject droplets of recording liquid and a sub tank configured to supply the recording liquid to the recording head, the engine unit being removable from and attachable to the main body in a direction parallel to the main scanning direction;

a nozzle maintaining and recovering unit provided in the engine unit and disposed at the back side of the main body, the nozzle maintaining and recovering unit being configured to maintain a normal state of the nozzles of the recording head and to recover from an abnormal state thereof; and a recording liquid supplying mechanism configured to supply the recording liquid to the recording head, wherein the recording liquid supplying mechanism includes the sub tank, a recording liquid cartridge configured to supply the recording liquid to the sub tank via at least one recording liquid tube, and a cartridge storing unit disposed at the front side of the main body relative to the nozzle maintaining and recovering unit and configured to store the recording liquid cartridge such that the recording liquid cartridge is removable from and attachable to the cartridge storing unit in a direction parallel to the main scanning direction, the engine unit includes a guide rod configured to guide the carriage in the main scanning direction, and the engine unit including the frame, the carriage and the guide rod is removable from the main body as a single unit by being pulled towards the front side of the main body, the nozzle maintaining and recovering unit is removable together with the engine unit by being pulled towards the front side of the main body in a state where the carriage is disposed at a position opposing the nozzle maintaining and recovering unit at the back side of the main body; and the recording liquid cartridge is removable from the cartridge storing unit by being pulled towards the front side of the main body.

* * * * *